US005156946A

United States Patent [19]

Nagaoka et al.

[11] Patent Number: 5,156,946

[45] Date of Patent: Oct. 20, 1992

[54] SILVER HALIDE PHOTOGRAPHIC MATERIALS

[75] Inventors: Katsuro Nagaoka; Shinsuke Bando; Takefumi Hara, all of Kanagawa, Japan

[73] Assignee: Fuji Photo Film Co., Ltd, Kanagawa, Japan

[21] Appl. No.: 356,913

[22] Filed: May 25, 1989

[30] Foreign Application Priority Data

May 30, 1988 [JP] Japan ..... 63-132326
Jul. 6, 1988 [JP] Japan ..... 63-168165

[51] Int. Cl.[5] ..... G03C 1/02

[52] U.S. Cl. ..... 430/567; 430/569; 430/599; 430/564

[58] Field of Search ..... 430/567, 568, 569, 599, 430/564

[56] References Cited

U.S. PATENT DOCUMENTS 3,703,584 11/1972 Motter ..... 430/605
3,917,485 11/1975 Morgan ..... 430/606
4,623,612 11/1986 Nishikawa ..... 430/567
4,686,178 8/1987 Honda et al. ..... 430/567
4,828,972 5/1989 Ihama et al. ..... 430/569
4,923,793 5/1990 Shibahara ..... 430/567

FOREIGN PATENT DOCUMENTS 0272675 6/1988 European Pat. Off. .
2402130 1/1973 Fed. Rep. of Germany .

*Primary Examiner*—Hoa Van Le
*Attorney, Agent, or Firm*—Sughrue, Mion, Zinn Macpeak & Seas

[57] ABSTRACT

A silver halide photographic material comprising at least one silver halide emulsion layer on a support, wherein the latent image distribution of silver halide grains contained in the at least one emulsion layer has at least one peak value within the grains, the location of the peak value is at a depth of less than 0.01 μm from the surface of the grains, and the average silver iodide content of the grains is about 15 mol % or less.

4 Claims, No Drawings

SILVER HALIDE PHOTOGRAPHIC MATERIALS

FIELD OF THE INVENTION

This invention relates to silver halide photo-graphic materials and, more particularly, it relates to silver halide photographic materials which give a good image quality.

BACKGROUND OF THE INVENTION

In recent years, there has been an increasing demand for improved sensitivity and improved image quality in silver halide photographic materials.

In this regard, the internal latent image silver halide emulsions which are to be found in U.S. Pat. No. 3,979,213 (hereinafter referred to as document A), *The Journal of Photographic Science,* Vol. 13, p. 48 (1965), ibid., Vol. 22, p. 174 (1974), ibid., Vol. 25, p. 19 (1977), ibid., Vol. 31, p. 41 (1986), *Photographic Science and Engineering,* Vol. 19, p. 333 (1975), U.S. Pat. Nos. 4,035,185 and 3,850,637, and in *Berichte der Bunsengesellschaft for Physikalische Chemie,* Vol. 67, p. 356 (1963) are outstanding in their color sensitization properties with markedly smaller intrinsic desensitization upon color sensitization than surface latent image emulsions, and additionally they are outstanding in the latent image storage properties since the latent image is formed inside the emulsion grain.

However, because the latent image-forming part lies deep within the emulsion grain at 0.01 μm or more, development is inadequate with these internal latent image emulsions even when carrying out development processing with the developing solutions for black-and-white, color negative or color reversal photographic materials which are used in practice and it has not been possible to produce the optimum sensitivity/granularity ratio.

On the other hand, silver halide emulsions with a high silver iodide content (for example, 5 mol% or more) are excellent in their sensitivity and granularity, but the storage properties of the latent image are poor and they also have undesirable tendencies such as a lack of susceptibility to the interimage effect, particularly with color reversal materials, and there is a great desire for technical developments to supplement the disadvantages of such high iodide emulsions.

The interimage effect is described, for example, on pages 663 to 669 of Volume 42 of *Journal of the Optical Society of America* by Hanson et al., and on pages 106 to 118 and 246 to 255 of Volume 47 of *Zeitschrift for Wissenschaftliche Photographic, Photophysique und Photochemie* by A. Thiels.

There have been attempts to control the halogen composition within the grain in an endeavor to improve the color sensitization properties and the granularity. However, there have been no specific discussions as to what kind of halogen composition distribution is preferable within the grain or investigations into the internal and external halogen composition in the portion forming the latent image in internal latent image grains.

SUMMARY OF THE INVENTION

Thus, the object of this invention is firstly to provide silver halide photographic materials which are excellent in their sensitivity and granularity, secondly to provide silver halide photographic materials which are outstanding in their storage properties, and thirdly to provide silver halide photographic materials which are outstanding in the interimage effect.

The above objectives of this invention are achieved by means of a silver halide photographic material (1) comprising at least one silver halide emulsion layer on a support, wherein the latent image distribution of the silver halide grains contained in the at least one emulsion layer has at least one peak value within the grains, the location of the peak value is at a depth less than 0.01 82 m from the surface of the grains, and the average silver iodide content of the grains is 15 mol % or less.

The above objectives of this invention are also achieved by means of a silver halide photographic material (2) comprising at least one silver halide emulsion layer on a support, wherein the latent image distribution of the silver halide grains contained in the at least one emulsion layer has at least one peak value within the grains, the location of the peak value is at a depth less than 0.01 μm from the surface of the grains, and the silver iodide content of the grain surface region is 90% or less of the average content of the whole grains.

DETAILED DESCRIPTION OF THE INVENTION

The latent image distribution as referred to here is the depth of the latent image from the grain surface on the abscissa (x) (x μm) and the latent image number on the ordinate (y).

wherein:

$$x = S/2 \times \left(1 - \sqrt[3]{Ag_1/Ag_0}\right)$$

S: the average grain size of the silver halide emulsion (μm)

$Ag_1$: the residual silver amount after subjecting the unexposed emulsion coating sample to the processing described hereafter $Ag_O$: the coated silver amount prior to processing and y is the reciprocal of the exposure giving a density with a fogging of +0.2 when carrying out the processing described below, after exposure of a white light for 1/100 second. The processing conditions when determining the above latent image distribution involve adding 0 to 10 g/liter of anhydrous sodium sulfite to a processing solution comprising:

| | |
|---|---|
| N-Methyl-p-aminophenol Sulfate | 2.5 g |
| L-Ascorbic Acid Sodium Salt | 10 g |
| Sodium Metaborate | 35 g |
| Potassium Bromide | 1 g |
| Water to make | 1 liter |
| pH | 9.6 |

and then processing for 5 minutes at 25° C. By varying the amount of anhydrous sodium sulfite between 0 and 10 g/liter, the depth at which the latent image in the silver halide grain developed during processing is to be found from the surface varies, and it is possible to determine the variation in the latent image number in the depth direction.

This invention is explained in more detail below.

The internal latent image emulsion is subjected to development processing using a developing solution which is used for black-and-white, color negative or color reversal photographic materials in practice and, in order to produce the optimum sensitivity, it is necessary to control the grain formation conditions of the emulsion and to control the location (depth) of the peak value(s) of the latent image distribution. It is clear that the internal latent image emulsions optimized in this way are not only superior to surface latent image emulsions of an equal grain size in their blue sensitivity and their color sensitization properties, but they also have good latent image storage properties and they are capable of a good interimage effect when used in multilayer photosensitive materials.

With emulsions with a high silver iodide content, even when the iodide ions released by the development of the other layers diffuse into the layers containing these emulsions, there is a particular tendency for the iodide ion-induced development inhibition to decrease and for the interimage effect to weaken. However, it is possible to sustain a large interimage effect when using the internal latent image emulsions of this invention.

The "processing solutions used in practice" as mentioned above do not include the developing solutions from which silver halide solvents have been excluded with a view to developing only the surface latent image, nor do they include the developing solutions in which large quantities of silver halide solvents are present with a view to developing the internal latent image.

With the former developing solutions, i.e., those from which silver halide solvents have been excluded, it is not possible to produce the optimum sensitivity of the internal latent image emulsions of this invention, and in the latter developing solutions, i.e., those in which large quantities of silver halide solvents are present, the silver halides are overly dissolved during processing thereby deteriorating the granularity by infectious development. Specifically, it is preferable that the developing solutions contain 100 mg/liter or less of potassium iodide or 100 g/liter or less of sodium sulfite or potassium sulfite as the silver halide solvent. Apart from these, it is possible to use, for example, potassium thiocyanate as the silver halide solvent.

The emulsions of this invention can be color sensitized by methods well known in the industry. The amount of sensitizing dye should be the amount with which a minus blue sensitivity maximum is obtained, and this amount will be of the same order as that for obtaining a maximum minus blue sensitivity in surface latent image emulsions; and if the dyes are added in much larger amounts than this, grain development is inhibited which is undesirable.

The emulsions of this invention can also be used without having been color sensitized. In such cases, it is not possible to expect the color sensitization effects disclosed in document A, but improvements will be observed in the interimage effect and the storage properties.

Silver iodobromide or silver iodochlorobromide with an average silver iodide content of 15 mol % or less are used in the silver halide photographic emulsions used in the photographic material (1) of this invention. These are preferably silver iodobromide or silver iodochlorobromide containing from 3 mol % to 15 mol %, and more preferably from 5 to 10 mol % of silver iodide. For the photographic material (2) of this invention, the silver iodide content in the surface region of the internal latent image silver halide grains is 90% or less of the average content of the whole grain. In the photographic material (2), there are no particular limitations on the silver iodide content of the silver halide grains, although it suitably is 15 mol % or less and preferably 3 to 15 mol %.

It has become clear that when varying the surface silver iodide content in the above internal latent image silver halide grains, the improvement in the latent image storage properties is particularly marked when the silver iodide content in the outside of the grain beyond the vicinity of the location in which the latent image forms is made lower than that on the inside. It has not hitherto been suspected from studies of the silver iodide content in surface latent image systems that the internal distribution in the grain has a large effect on improving the sensitivity and storage properties of such internal latent image systems, although it is possible to explain this phenomenon if it is considered that the rate at which the emulsion grains are dissolved by the developing solution up to the position which has been chemically sensitized is controlled by the silver iodide content of the grain surface.

The part in which the silver iodide content is lower than the average silver iodide content of the grain may be: (1) only the extreme surface of the grain, (2) the region from outside the vicinity of the location at which the latent image is principally formed up to the surface, or (3) the region from inside the vicinity of the location at which the latent image forms up to the grain surface, although (3) gives more preferable results in terms of improvement in the latent image storage properties.

The silver halide grains may be the so-called regular grains having a cubic, octahedral, tetradecahedral or other such regular crystal form, they may have a tabular, spherical or other such irregular crystal form, they may be grains having a twin crystal plane or other such crystal flaw or they may be complex forms of these.

Tabular grains with an aspect ratio of 5 or more and regular grains are preferably used in this invention.

The silver halide grain size includes fine grains of approximately 0.1 μm or less and large sized grains with projected surface area diameters of up to approximately 10 μm, or alternatively there are mono-dispersed emulsions having a narrow distribution and emulsions having a wide distribution, the monodispersed emulsions being preferred in that they improve the graininess.

Monodispersed emulsions are represented by emulsions of the kind in which at least 95% by weight of the grains are within ±40% of the average grain diameter. Emulsions of the type in which the average grain diameter is 0.05 to 3 μm and at least 95% by weight or at least 95% (grain number) are within the range ±20% of the average grain diameter can be used in this invention. Production methods for such emulsions are disclosed in U.S. Pat. Nos. 3,574,628, 3,655,394 and British Patent 1,413,748. Furthermore, monodispersed emulsions of the kind disclosed in JP-A-48-8600, JP-A-51-39027, JP-A-51-83097, JP-A-53-137133, JP-A-54-48521, JP-A-54-99419, JP-A-58-37635 and JP-A-58-49938 (the term "JP-A" as used herein refers to a "published unexamined Japanese patent application") can also preferably be used in this invention.

Production methods for so-called core/shell emulsions disclosed in, for example, U.S. Pat. Nos. 3,979,213, 3,966,476, 3,206,313, 3,917,485 and in JP-B-43-29405 and JP-B-45-13259 (the term "JP-B" as used herein refers to an "examined Japanese patent publication") can be used as methods for producing internal latent image emulsions, although with all these methods it is necessary for the shell thickness to be 0.01 μm or less and preferably 0.003 to 0.008 μm, and to adjust deposition conditions and the silver halide amount deposited after the chemical sensitization of the core in order to obtain an emulsion having the optimum sensitivity/-granularity ratio with the practical processing solutions of this invention.

More specifically, in U.S. Pat. No. 3,979,213, the internal latent image emulsion is prepared by a method in which the silver halide is redeposited onto emulsion grains with chemically sensitized surfaces using the controlled double jet method. If the amount of silver halide used in this patent was deposited onto the grains, there would be insufficient development with practical developing solutions and the sensitivity and granularity would deteriorate. For this reason, the amount of silver halide deposited after chemical sensitization must be less than that used in U.S. Pat. No. 3,979,213 as mentioned above.

Furthermore, a method in which silver halide is deposited onto the emulsion grains after chemical sensitization using the controlled double jet method is also described in U.S. Pat. No. 3,966,476. However, if after chemical sensitization the silver halide is deposited using a method such as that employed in this patent, it is not possible to bury the photosensitive nucleus within the grain. Accordingly, with the emulsion used in the above patent, the sensitivity will rise at least higher than 0.02 log E compared with the original emulsion in which the surface was chemically sensitized even when using surface development. In order to achieve the internal latent image emulsions of this invention, it is, therefore, necessary to achieve what is desired by increasing the amount of silver halide deposited after chemical sensitization beyond that employed in U.S. Pat. No. 3,966,476 and by controlling the deposition conditions (for example, the solubility of the silver halide and the rate of addition of soluble silver salts and soluble halide salts during the deposition).

When using the above-mentioned tabular grains in this invention, in order to accelerate the grain growth, it is preferable to use the methods in which the rate of addition, the added amounts and the added concentrations of the silver salt solutions (for example, aqueous $AgNO_3$ solution) and halide solutions (for example, aqueous KBr solution) which are added during production are increased.

With respect to these methods, it is possible to refer to the disclosures in, for example, British patent 1,335,925, U.S. Pat. Nos. 3,672,900, 3,650,757, 4,242,445 and JP-A-55-142329 and JP-A-55-158124.

The properties of the silver halide grains can be controlled by the presence of various compounds in the silver halide deposition formation stage. Such compounds may initially be present in the reaction vessel, or they can be added together with 1 or 2 or more salts following the usual methods. The characteristics of the silver halide can be controlled by the presence of compounds such as compounds of Group VIII noble metals and gold, zinc (sulfur, selenium and tellurium and other such chalcogen compounds), cadmium, bismuth, lead, iridium and copper as disclosed in U.S. Pat. Nos. 2,448,060, 2,628,167, 3,737,313, 3,772,031, and in *Research Disclosure,* Vol. 134 (June, 1975), No. 13452, during the silver halide deposition formation stage. It is possible to effect reduction sensitization of the inside of the grains of silver halide emulsions during the deposition formation stage as disclosed in JP-B-58-1410 and *Journal of Photographic Science,* Vol. 25, 1977, pp. 19–27 by Moisar et al.

For the chemical sensitization, it is possible to use active gelatin as disclosed in *The Theory of the Photographic Process,* 4th Ed., Macmillan, 1977, pp. 67–76 by T. H. James, or alternatively it is possible to use sulfur, selenium, tellurium, gold, platinum, palladium, iridium, or combinations of a plurality of these sensitizing agents under conditions of a pAg of 5 to 20, a pH of 5 to 8 and temperatures of 30 to 80° C. as disclosed in *Research Disclosure,* Vol. 120 (April, 1974), No. 12008; *Research Disclosure,* Vol. 134 (June, 1975), No. 13452; U.S. Pat. Nos. 2,642,361, 3,297,446, 3,772,031, 3,857,711, 3,901,714, 4,266,018 and 3,904,415 and also in British Patent 1,315,755. Most suitably, the chemical sensitization is carried out in the presence of a gold compound with a thiocyanate compound, or with a sulfur-containing compound, or in the presence of sulfur-containing compounds such as "Hypo", thiourea-type compounds and rhodanine-type compounds as disclosed in U.S. Pat. Nos. 3,857,711, 4,266,018 and 4,054,457. It is also possible to effect the chemical sensitization in the presence of auxiliary chemical sensitization agents. Compounds such as azaindenes, azapyridazines and azapyrimidines, which are known to inhibit fogging during the chemical sensitization stage and to increase the sensitivity, are used as the auxiliary chemical sensitization agents. Examples of auxiliary chemical sensitization agent are disclosed in U.S. Pat. Nos. 2,131,038, 3,411,914, 3,554,757, JP-A-58-126526 and in G. F. Duffin, *Photographic Emulsion Chemistry,* Focal Press, 1966, pp. 138-143. In addition to chemical sensitization, or in place of it, it is possible to carry out reduction sensitization using, for example, hydrogen as disclosed in U.S. Pat. Nos. 3,891,446 and 3,984,249, or to carry out reduction sensitization using reducing agents such as stannous chloride, thiourea dioxide and polyamines as disclosed in U.S. Pat. Nos. 2,518,698, 2,743,182 and 2,743,183 or else using a method involving a low pAg (for example, less than 5) and/or a high pH (for example, greater than 8).

In this invention, the above-mentioned chemical sensitization is carried out after the formation of the core grains in such a way that the peak value of the latent image distribution is on the surface of the grains and it is necessary to provide optimum conditions by controlling the silver halide type, the pAg, the pH, the chemical sensitizing agents used and other such factors.

Furthermore, after producing a shell of the above-mentioned thickness, they should preferably be set such that the latent image number on the shell surface is 1/5 or more and less than 1 time the peak value, more preferably 0.3 to 0.6 time of the peak value. The conditions for the control of the shell surface latent image number will vary depending upon the pH, pAg, and the silver halide type used in the shell producing stage, chemical sensitization will be carried out as required.

The emulsions of this invention which are obtained from the above stage have at least one peak value in their internal grain latent image distribution within the grain and the location of the above-mentioned peak value is less than 0.01 μm and preferably 0.008 μm from the grain surface.

A plurality of the emulsions of this invention can be mixed and used in the same emulsion layer. Furthermore, they may be used in conjunction with the usual so-called "surface latent image emulsions". Furthermore, the emulsions of this invention and the usual emulsions mentioned above can be used singly between emulsion layers having the same color sensitivity or different color sensitivities.

When two kinds of the internal latent image emulsions are mixed and used, and the respective average grain size ratios are 1.1 to 1.6, an improved sensitivity/-granularity ratio and sensitization processing can be obtained.

Furthermore, silver halide grains in which the ratio of surface latent image numbers to internal latent image numbers is about 1/5 or more and less than 1 are preferably used in this invention.

The usual silver halide photographic emulsions mentioned above which are used in this invention can be prepared by known methods and, for example, it is possible to follow the methods disclosed in *Research Disclosure,* Vol. 176, No. 17643 (December, 1978), pages 22 and 23 "I. Emulsion Preparation and Types" and in *Research Disclosure,* Vol. 187, No. 18716 (November, 1979), p. 648.

Noodle washing, flocculation precipitation or ultrafiltration or the like is used to eliminate the soluble silver salts from the emulsion before or after the time of physical ripening.

The additives which are used in chemical ripening and spectral sensitization of the emulsions used in this invention are disclosed in the aforementioned *Research Disclosure,* No. 17643 (December, 1978) and *Research Disclosure,* No. 18716 (November, 1979) and their relevant locations have been collated into the following table.

Known photographic additives which can be used in this invention are also disclosed in the above two *Research Disclosures* and the locations of their disclosures are shown in the following table.

| Type of Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizing Agents, Supersensitizing Agents | Pages 23–24 | Page 648, right column to page 649, right column |
| 4. Whitening Agents | Page 24 | — |
| 5. Antifoggants and Stabilizers | Pages 24–25 | Page 649, right column |
| 6. Light Absorbers, Filter Dyes, Ultraviolet Absorbers | Pages 25–26 | Page 649, right column to page 650, left column |
| 7. Antistaining Agents | Page 25, right column | Page 650, left to right columns |
| 8. Color Image Stabilizers | Page 25 | — |
| 9. Film Hardening Agents | Page 26 | Page 651, left column |
| 10. Binders | Page 26 | Page 651, left column |
| 11. Plasticizers, Lubricants | Page 27 | Page 650, right column |
| 12. Coating Aids, Surfactants | Pages 26–27 | Page 650, right column |
| 13. Antistatic Agents | Page 27 | Page 650, right column |

Various color couplers can be used in this invention and specific examples of them are disclosed in the patents disclosed in the aforementioned *Research Disclosure* (RD), No. 17643, VII-C to G.

The substances disclosed, for example, in U.S. Pat. Nos. 3,933,501, 4,022,620, 4,326,024, 4,401,752, JP-B-58-10739, British Patents 1,425,020 and 1,476,760 are preferred as yellow couplers.

As magenta couplers, 5-pyrazolone-type and pyrazoloazole-type compounds are preferred and the substances disclosed, for example, in U.S. Pat. Nos. 4,310,619, 4,351,897, European Patent 73,636, U.S. Pat. Nos. 3,061,432, 3,725,067, *Research Disclosure,* No. 4220 (June, 1984), JP-A-60-33552, *Research Disclosure,* No. 24230 (June, 1984), JP-A-60-43659, U.S. Pat. Nos. 4,500,630 and 4,540,654 are particularly preferred.

Phenol-type and naphthol-type couplers can be mentioned as cyan couplers, the substances disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Laid-Open Patent 3,329,729, European Patent 121,365A, U.S. Pat. Nos. 3,446,622, 4,333,999, 4,451,559, 4,427,767 and European Patent 161,626A being preferred.

The colored couplers disclosed in *Research Disclosure, No.* 17643, section VII-G, U.S. Pat. No. 4,163,670, JP-B-57-39413, U.S. Pat. Nos. 4,004,929 and 4,138,258 and British Patent 1,146,368 are preferred for correcting unwanted absorption of the color-forming dyes.

Typical examples of polymerized dye-forming couplers are disclosed in U.S. Pat. Nos. 3,451,820, 4,080,211, 4,367,282 and British Patent 2,102,173.

Couplers which release photographically useful residual groups during coupling are also preferably used in this invention. The substances disclosed in -the patents disclosed in the aforementioned RD, 17643, section VII-S, and in JP-A-57-151944, JP-A-57-154234, JP-A-60-184248 and U.S. Pat. No. 4,248,962 are preferred for DIR couplers which release development inhibiting agents.

The substances disclosed in British Patents 2,097,140, 2,131,188, JP-A-59-157638 and JP-A-59-170840 are preferred as couplers which release development accelerators or nucleating agents in image form during development.

Competitive couplers disclosed, for example, in U.S. Pat. No. 4,130,427, the polyequivalent couplers as disclosed, for example, in U.S. Pat. Nos. 4,283,472, 4,338,393, 4,310,618, the DIR redox compound-releasing couplers as disclosed, for example, in JP-A-60-185950, and the couplers which release dyes of which the color is restored after elimination as disclosed, for example, in European Patent 173,302A can be used in the photographic materials of this invention as couplers.

The couplers which are used in this invention can be introduced into the photographic materials using various known dispersion methods.

With the photographic materials according to this invention, it is preferable to provide, where suitable, protective layers, intermediate layers, filter layers, antihalation layers, backing layers, white light reflection layers and other such auxiliary layers in addition to the silver halide emulsion layers.

In such cases, in this invention, it is preferable that the distance between the layer containing the aforementioned emulsions of this invention and the photographic material surface is 25 μm or less, and it is further preferable that the film swelling rate is 2 or more (in the development processing solution).

With the photographic materials of this invention, the photographic emulsion layers and the other layers are coated onto the supports disclosed in *Research Disclosure,* No. 17643, section V-VII (December, 1978), p. 28 and in European Patent 0,102,253 and JP-A-61-97655. Moreover, it is possible to use the coating method disclosed in *Research Disclosure,* No. 17643, section XV, pp. 28 and 29.

This invention can also be applied to multi-layered polychromatic photographic materials having at least two layers of differing spectral sensitivities on the support. Natural colored multilayered photographic materials usually have at least one red-sensitive emulsion layer, green-sensitive emulsion layer and blue-sensitive emulsion layer respectively on the support. The order of these layers is selected arbitrarily as required. The order of preferred layer sequences are, from the support, red-sensitive, green-sensitive, blue-sensitive or, from the support, green-sensitive, red-sensitive, blue-sensitive. Furthermore, the various emulsion layers mentioned previously may be composed of emulsion layers with two or more different sensitivities and there may be non-photosensitive layers between two or more emulsion layers which have the same color sensitivity. It is usual to include a cyan-forming coupler in the red-sensitive emulsion layer, a magenta-forming coupler in the green-sensitive emulsion layer and a yellow-forming coupler in the blue-sensitive emulsion layer, but different combinations can be adopted according to circumstances.

Various color-photosensitive materials are suitable for use with this invention.

For example, color reversal films, color reversal papers, instant color films for slides and television and the like can be cited as representative examples. Furthermore, they can also be suitably used as hard color copies for preserving CRT and full color copier images. This invention is also suitable for use in black-and-white photographic materials employing a three color coupler mixture disclosed, for example, in *Research Disclosure,* No. 17123 (July, 1978).

The color developing solutions which are used in the development processing of the photographic materials of this invention are preferably alkaline aqueous solutions with primary aromatic amine-type color developing agents for their main constituents. Aminophenol-type compounds are useful as these color development agents but p-phenylenediamine-type compounds are preferably used, and representative examples of these include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and the sulfuric acid salts, hydrochloric acid salts or p-toluenesulfonic acid salts thereof. Two or more of these compounds can be used together according to the objective.

When reversal processing is to be carried out, the color development is effected after carrying out the usual black-and-white development. For this black-and-white developing solution, it is possible to use known black-and-white developing agents such as dihydroxybenzenes (for example, hydroquinone), 3-pyrazolidones (for example, 1-phenyl-3-pyrazolidone) or aminophenols (for example, N-methyl-p-aminophenol) either singly or in combination.

The pH of these color developing solutions and black-and-white developing solutions is generally between 9 and 12.

Bleach processing is normally carried out on the photographic emulsion layers after color development. The bleach processing may be carried out at the same time as a fixing process (bleach-fixing process) or it may be carried out separately. In addition, the processing method in which bleach-fixing processing is carried out after the bleaching process may be undertaken in order to accelerate the processing.

The silver halide color photographic materials of this invention will generally undergo washing and/or stabilization stages after a desilvering process.

The pH of the washing water in the processing of the photographic materials of this invention is between 4 and 9, preferably 5 and 8.

Color developing agents may be incorporated into the silver halide color photographic materials of this invention with a view to simplifying and accelerating processing. For the incorporation, it is preferable to use various precursors of the color developing agents.

The various processing solutions in this invention are used at 10° C. to 50° C. Normally, a temperature of 33° C. to 40° C. will be standard but it is possible to accelerate the processing and reduce the processing time by having higher temperatures, or, conversely, to achieve an improvement in the image quality and in the stability of the processing solution by having lower temperatures.

It is possible to use the various known developing agents in order to develop black-and-white photographic materials in this invention. Thus, it is possible to use, either singly or in combination, polyhydroxybenzenes (for example, hydroquinone, 2-chlorohydroquinone, 2-methylhydroquinone, catechol, pyrogallol); aminophenols (for example, p-aminophenol, N-methyl-p-aminophenol, 2,4-diaminophenol); 3-pyrazolidones (for example, 1-phenyl-3-pyrazolidone, 1-phenyl-4,4'-dimethyl-3-pyrazolidone, 1-phenyl-4-methyl-4-hydroxymethyl-3-pyrazolidone, 5,5-dimethyl-1-phenyl-3-pyrazolidone) and ascorbic acids. Furthermore, it is possible to use the developing solution disclosed in JP-A-58-55928.

Detailed specific examples of developing agents, preservatives, buffering agents and development methods for black-and-white photographic materials and methods for the use thereof are disclosed, for example, in *Research Disclosure,* No. 17643 (December, 1978), section XIX-XXI.

The invention is explained in further detail below making use of examples, but the invention is not limited by these examples.

Unless otherwise specified, all ratios, percents, etc., are by weight.

EXAMPLE 1

The eight types of silver iodobromide emulsions shown in Table 1 were prepared (grain size 0.3 μm)

TABLE 1

| Emulsion | Average AgI Content (mol %) | Peak Value of Latent Image Distribution (μm) |
|---|---|---|
| A | 9 | 0.008 |
| B | 9 | 0 |
| C | 4 | 0.008 |
| D | 6 | " |
| E | 14 | " |
| F | 20 | " |
| G | 9 | 0.003 |
| H | 9 | 0.012 |

The production methods for these emulsions are given below.

Emulsion A:

A monodispersed emulsion having a (100) crystal habit was prepared by adding a 15% silver nitrate solution and an aqueous solution containing KBr and KI to an aqueous gelatin solution (0.037%) maintained at 72° C., using the double jet method over 47 minutes, while maintaining the silver potential (SCE) at +90 mV. Thus, the core emulsion was obtained. Following this, sodium thiosulfate and sodium chloroaurate were added to the core emulsion as chemical sensitizers and chemical ripening was carried out for 55 minutes. The temperature was then reduced to 50° C. and the final size was made 0.3 μm and the average silver iodide content 9 mol % by shell deposition for 7 minutes again adding a 15% silver nitrate solution and an aqueous solution containing KBr and KI. The peak value of the latent image distribution was at a depth 0.008 μm from the surface.

Emulsion B:

Shell deposition was carried out on the same core emulsion as in Emulsion A and under the same conditions as for Emulsion A and then chemical sensitization was carried out.

Emulsions C, D, E, F:

Emulsions with the same latent image distribution as Emulsion A and with average silver iodide contents of 4, 6, 14 and 20 mol % were prepared with the same methods as for Emulsion A and these were Emulsions C, D, E, F.

Emulsion G:

Emulsion G was prepared under the same conditions as for Emulsion A except that the core addition time was extended to 53 minutes and the shell addition time was 3 minutes, in other words the core/shell ratio was adjusted under similar conditions to those for Emulsion A. The peak value of the latent image distribution of this emulsion was at a depth 0.003 μm from the surface.

Emulsion H:

Emulsion H was prepared under the same conditions as for Emulsion A with a core addition time of 43 minutes and a shell addition time of 12 minutes. The peak value of the latent image distribution of this emulsion was at a depth 0.012 μm from the surface.

Sensitizing Dye S-1 was added to the above emulsions and coated onto cellulose triacetate film supports in an amount of 2 g of silver per $m^2$, respectively.

The above films were exposed for 1/100 second through either a blue filter (BPN-42) or through a minus blue filter (SC-39) and development processing was carried out under the processing conditions given below.

The sensitometry results so obtained are shown in Table 2. Here, the sensitivity is shown as the value corresponding to the reciprocal of the exposure which gives a density of fogging +0.1.

Furthermore, the graininess is shown by the value at a density of 1.0 using the customary RMS measurement values when the sensitizing dye is used in an amount of 0.2 mmol/mol Ag and minus blue exposure is conducted. The results are shown in Table 2.

It will be seen from the results that the photographic materials containing emulsions having the specific average silver iodide content and the latent image distribution of this invention are superior to the comparative emulsions in their sensitivity, graininess and storage properties.

For example, the average silver iodide content of Emulsions C, D, E and F is different to that of this invention and they are inferior to this invention in their sensitivity and graininess. Furthermore, the latent image distribution of Emulsions B and H is different to that of this invention and they are inferior to the emulsions of this invention in their sensitivity and storage properties.

Processing Conditions:

Processing for 4 minutes at 30° C. in a processing solution composed of:

| | |
|---|---|
| 1-Phenyl-3-pyrazolidone | 0.5 g |
| Hydroquinone | 10 g |
| Ethylenediaminetetraacetic Acid Disodium Salt | 2 g |
| Potassium Sulfite | 60 g |
| Boric Acid | 4 g |
| Potassium Carbonate | 20 g |
| Sodium Bromide | 5 g |
| Diethylene Glycol | 20 g |
| Sodium Hydroxide to adjust pH to | 10.0 |
| Water to make | 1 liter |

TABLE 2

| Emulsion | Dye (mmol/mol Ag) | Blue Exposure Relative Sensitivity | Minus-Blue Exposure Relative Sensitivity | Relative Sensitivity after Storage for 3 Days at 50° C. Following Blue Exposure | RMS Value |
|---|---|---|---|---|---|
| A | — | 113 | — | 94 | |
| (Invention) | 0.1 | 106 | 1,180 | 89 | |
| | 0.2 | 92 | 1,230 | 81 | 0.019 |
| | 0.4 | 43 | 590 | 37 | |
| B | — | 100 | — | 67 | |
| (Comparison) | 0.1 | 82 | 940 | 61 | |
| | 0.2 | 57 | 790 | 42 | 0.018 |
| | 0.4 | 41 | 560 | 25 | |
| C | — | 98 | — | 78 | |
| (Comparison) | 0.2 | 76 | 1,080 | 70 | 0.022 |
| D | — | 107 | — | 86 | |
| (Invention) | 0.2 | 87 | 1,180 | 76 | 0.020 |
| E | — | 105 | — | 83 | |
| (Invention) | 0.2 | 84 | 1,120 | 74 | 0.018 |
| F | — | 94 | — | 75 | |
| (Comparison) | 0.2 | 70 | 950 | 62 | 0.019 |

TABLE 2-continued

| Emulsion | Dye (mmol/mol Ag) | Blue Exposure Relative Sensitivity | Minus Blue Exposure Relative Sensitivity | Relative Sensitivity after Storage for 3 Days at 50° C. Following Blue Exposure | RMS Value |
|---|---|---|---|---|---|
| G | — | 114 | — | 92 | |
| (Invention) | 0.2 | 90 | 1,190 | 77 | 0.018 |
| H | — | 92 | — | 76 | |
| (Comparison) | 0.2 | 71 | 930 | 62 | 0.023 |

EXAMPLE 2

A multilayer color photosensitive material composed of various layers with the compositions shown below was prepared on a cellulose triacetate support which had undergone an undercoating treatment.

| | |
|---|---|
| **Layer 1: Antihalation Layer** | |
| Black Colloidal Silver | 0.25 g/m$^2$ |
| Ultraviolet Absorber U-1 | 0.1 g/m$^2$ |
| Ultraviolet Absorber U-2 | 0.1 g/m$^2$ |
| High Boiling Point Organic Solvent, Oil-1 | 0.1 cc/m$^2$ |
| Gelatin | 1.9 g/m$^2$ |
| **Layer 2: Intermediate Layer 1** | |
| Compound Cpd D | 10 mg/m$^2$ |
| High Boiling Point Organic Solvent, Oil-3 | 40 mg/m$^2$ |
| Gelatin | 0.4 g/m$^2$ |
| **Layer 3: Intermediate Layer 2** | |
| Surface-Fogged Fine-Grained Silver Iodobromide Emulsion (average grain size: 0.06 μm, AgI content: 1 mol %) | 0.05 g/m$^2$ (as silver) |
| Gelatin | 0.4 g/m$^2$ |
| **Layer 4: First Red-Sensitive Emulsion Layer** | |
| Silver Iodobromide Emulsion Spectrally Sensitized with Sensitizing Dyes S-1 and S-2 (average grain size: 0.2 μm, AgI content: 5 mol %) | 0.4 g/m$^2$ (as silver) |
| Coupler C-1 | 0.2 g/m$^2$ |
| Coupler C-2 | 0.05 g/m$^2$ |
| High Boiling Point Organic Solvent, Oil-1 | 0.1 cc/m$^2$ |
| Gelatin | 0.8 g/m$^2$ |
| **Layer 5: Second Red-Sensitive Emulsion Layer** | |
| Silver Iodobromide (mentioned in Table 3) Spectrally Sensitized by Sensitizing Dyes S-1 and S-2 | 0.4 g/m$^2$ (as silver) |
| Coupler C-1 | 0.2 g/m$^2$ |
| Coupler C-3 | 0.2 g/m$^2$ |
| Coupler C-2 | 0.05 g/m$^2$ |
| High Boiling Point Organic Solvent, Oil-1 | 0.1 cc/m$^2$ |
| Gelatin | 0.8 g/m$^2$ |
| **Layer 6: Third Red-Sensitive Emulsion Layer** | |
| Silver Iodobromide Emulsion (a spherical multidispersed emulsion with an average grain size of 0.7 μm and an AgI content of 2 mol %) Spectrally Sensitized with Sensitizing Dyes S-1 and S-2 | 0.4 g/m$^2$ (as silver) |
| Coupler C-3 | 0.7 g/m$^2$ |
| Gelatin | 1.1 g/m$^2$ |
| **Layer 7: Intermediate Layer 3** | |
| Dye D-1 | 0.02 g/m$^2$ |
| Gelatin | 0.6 g/m$^2$ |
| **Layer 8: Intermediate Layer 4** | |
| A Surface-Fogged Fine-Grained Silver Iodobromide Emulsion (average grain size: 0.06 μm, AgI Content: 1 mol %) | 0.05 g/m$^2$ (as silver) |
| Compound Cpd A | 0.2 g/m$^2$ |
| Gelatin | 1.0 g/m$^2$ |
| **Layer 9: First Green-Sensitive Emulsion Layer** | |
| Silver Iodobromide Emulsion (average grain size: 0.2 μm, AgI content: 5 mol %) Spectrally Sensitized with Sensitizing Dyes S-3 and S-4 | 0.5 g/m$^2$ (as silver) |
| Coupler C-4 | 0.3 g/m$^2$ |
| Compound Cpd B | 0.03 g/m$^2$ |
| Gelatin | 0.5 g/m$^2$ |
| **Layer 10: Second Green-Sensitive Emulsion Layer** | |
| Silver Iodobromide Emulsion (a monodispersed cubic emulsion with an average grain size of 0.4 μm, AgI content: 3 mol %) Containing Sensitizing Dyes S-3 and S-4 | 0.4 g/m$^2$ (as silver) |
| Coupler C-4 | 0.3 g/m$^2$ |
| Compound Cpd B | 0.03 g/m$^2$ |
| Gelatin | 0.6 g/m$^2$ |
| **Layer 11: Third Green-Sensitive Emulsion Layer** | |
| Silver Iodobromide Emulsion (tabular emulsion, average grain size: 0.7 μm, aspect ratio: 3, AgI content: 2 mol %) Containing Sensitizing Dyes S-3 and S-4 | 0.5 g/m$^2$ (as silver) |
| Coupler C-4 | 0.8 g/m$^2$ |
| Compound Cpd B | 0.08 g/m$^2$ |
| Gelatin | 1.0 g/m$^2$ |
| **Layer 12: Intermediate Layer 5** | |
| Dye D-2 | 0.05 g/m$^2$ |
| Gelatin | 0.6 g/m$^2$ |
| **Layer 13: Yellow Filter Layer** | |
| Yellow Colloidal Silver | 0.1 g/m$^2$ |
| Compound Cpd A | 0.01 g/m$^2$ |
| Gelatin | 1.1 g/m$^2$ |
| **Layer 14:** | |
| Gelatin | 1.1 g/m$^2$ |
| **Layer 15: First Blue-Sensitive Emulsion Layer** | |
| Silver Iodobromide Emulsion (monodispersed cubic emulsion, average grain size: 0.5 μm, AgI content: 3 mol %) Containing Sensitizing Dyes S-5 and S-6 | 0.6 g/m$^2$ (as silver) |
| Coupler C-5 | 0.6 g/m$^2$ |
| Gelatin | 0.8 g/m$^2$ |
| **Layer 16: Second Blue-Sensitive Emulsion Layer** | |
| Silver Iodobromide Emulsion (tabular emulsion, average grain size: 0.6 μm, aspect ratio: 7, AgI Content: 2 mol %) Containing Sensitizing Dyes S-5 and S-6 | 0.4 g/m$^2$ (as silver) |
| Coupler C-5 | 0.3 g/m$^2$ |
| Coupler C-6 | 0.3 g/m$^2$ |
| Gelatin | 0.9 g/m$^2$ |
| **Layer 17: Third Blue-Sensitive Emulsion Layer** | |
| Silver Iodobromide Emulsion (tabular emulsion, average grain size: 1.0 μm, aspect ratio: 7, AgI Content: 2 mol %) Containing Sensitizing Dyes S-5 and S-6 | 0.4 g/m$^2$ (as silver) |
| Coupler C-6 | 0.7 g/m$^2$ |
| Gelatin | 1.2 g/m$^2$ |
| **Layer 18: First Protective Layer** | |
| Ultraviolet Absorber U-1 | 0.04 g/m$^2$ |
| Ultraviolet Absorber U-3 | 0.03 g/m$^2$ |
| Ultraviolet Absorber U-4 | 0.03 g/m$^2$ |
| Ultraviolet Absorber U-5 | 0.05 g/m$^2$ |
| Ultraviolet Absorber U-6 | 0.05 g/m$^2$ |
| Compound Cpd C | 0.8 g/m$^2$ |
| Dye D-3 | 0.05 g/m$^2$ |
| Gelatin | 0.7 g/m$^2$ |
| **Layer 19: Second Protective Layer** | |
| Surface-Fogged Fine-Grained Silver Iodobromide Emulsion (average grain size: 0.06 μm, AgI content: 1 mol %) | 0.1 g/m$^2$ (as silver) |

-continued

| | |
|---|---|
| Polymethyl Methacrylate Particles (average particle size: 1.5 μm) | 0.1 g/m² |
| A 4/6 (molar ratio) Copolymer of Methyl Methacrylateand Acrylic Acid (average particle size: 1.5 μm) | 0.1 g/m² |
| Compound Cpd E | 0.03 g/m² |
| Fluorine-Containing Surfactant W-1 | 3 mg/m² |
| Gelatin | 2.1 g/m² |

In addition to the above constituents, Gelatin Hardening Agent H-1 and surfactants were added to the various layers.

Samples 201 and 202 were prepared using Emulsion A and Emulsion B of Example 1 in Layer 5 of the above sample.

These Samples 201 and 202 were each subjected to a wedge exposure with red light and the other portions were subjected to a wedge exposure with white (red +green +blue) light. The quantity of red light during the white exposure was the same as during the red exposure.

The samples which had undergone these exposures were subjected to the development processing shown below. The results are given in Table 3.

A greater difference in the exposure for a density equal to 1.0 in the comparison of the cyan of the red exposure part and the cyan of the white exposure part represents a larger interimage effect.

| Stage | Processing Time (min) | Temperature |
|---|---|---|
| First Development | 6 | 38° C. |
| Washing | 2 | " |
| Reversal | 2 | " |
| Color Development | 6 | " |
| Conditioning | 2 | " |
| Bleaching | 6 | " |
| Fixing | 4 | " |
| Washing | 4 | " |
| Stabilization | 1 | Room Temperature |
| Drying | | |

The following substances were used in the composition of the processing solutions.

| | |
|---|---|
| First Development Solution: | |
| Water | 700 ml |
| Nitrilo-N,N,N-trimethylenephosphonic Acid Pentasodium Salt | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml |
| Reversal Solution: | |
| Water | 700 ml |
| Nitrilo-N,N,N-trimethylenephosphonic Acid Pentasodium Salt | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developing Solution: | |
| Water | 700 ml |
| Nitrilo-N,N,N-trimethylenephosphonic Acid Pentasodium Salt | 3 g |
| Sodium Sulfite | 7 g |
| Sodium Triphosphate (dodecahydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N-Ethyl-N-(β-methanesulfonamidoethyl)-3-methyl-4-aminoaniline Sulfate | 11 g |
| 3,6-Dithiaoctane-1,8-diol | 1 g |
| Water to make | 1,000 ml |
| Adjustment Solution | |
| Water | 700 ml |
| Sodium Sulfite | 12 g |
| Ethylenediaminetetraacetic Acid Sodium Salt (dihydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Ethylenediaminetetraacetic Acid Sodium Salt (dihydrate) | 2 g |
| Ethylenediaminetetraacetic Acid Iron (III) Ammonium Salt (dihydrate) | 120 g |
| Potassium Bromide | 100 g |
| Water to make | 1,000 ml |
| Fixing Solution | |
| Water | 800 ml |
| Sodium Thiosulfate | 80.0 g |
| Sodium Sulfite | 5.0 g |
| Sodium Bisulfite | 5.0 g |
| Water to make | 1,000 ml |
| Stabilization Solution: | |
| Water | 800 ml |
| Formalin (37%) | 5.0 ml |
| Fuji Driwel (surfactant made by Fuji Photo Film Co., Ltd.) | 5.0 ml |
| Water to make | 1,000 ml |

The color reversal sensitivities were compared on the basis of the relative exposure giving a density of 1.0 greater than the maximum density.

TABLE 3

| Sample No. | Emulsion Used in Layer 5 | Relative Red Sensitivity in the White Exposed Part | Δ Log E for a Cyan Density = 1.0 |
|---|---|---|---|
| 201 (Invention) | A | 100 | 0.21 |
| 202 (Comparison) | B | 82 | 0.05 |

As indicated above, it will be seen that the sample which used an emulsion having the silver diode content and latent image distribution of this nveniton exhibits superior reversal sensitivity and produces a dramatically greater interimage effect than the sample of the comparative sample.

The structural formulae of compounds used in Example 2 are given below.

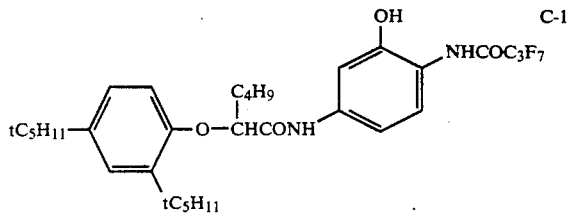

-continued
C-2
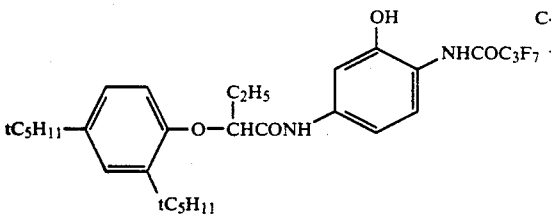
C-3
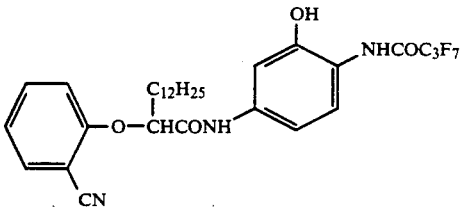
C-4
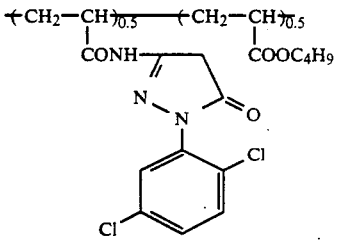
C-5
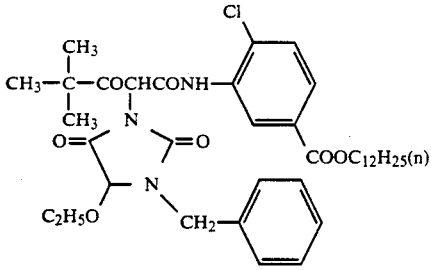
C-6
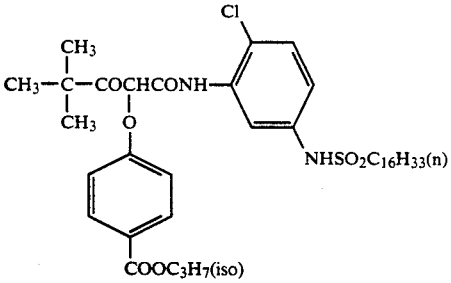
Oil 1: Dibutyl phthalate
Oil 3
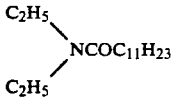
Cpd A
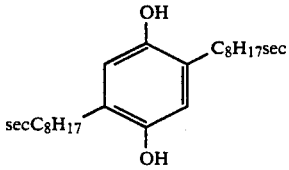
-continued
Cpd B
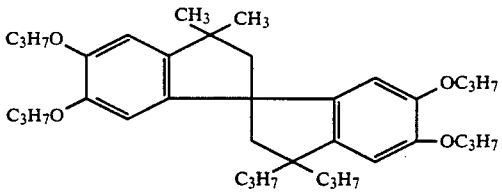
Cpd C
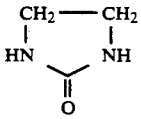
Cpd D
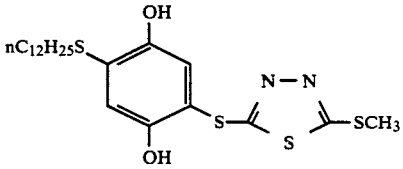
Cpd E
$C_{15}H_{31}COOC_{16}H_{33}$
U-1
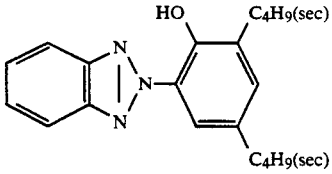
U-2
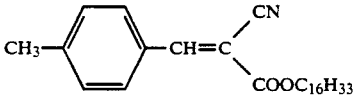
U-3
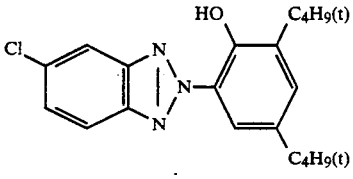
U-4
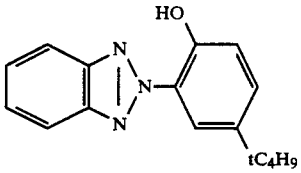
U-5
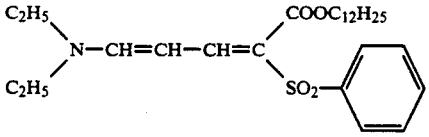
U-6
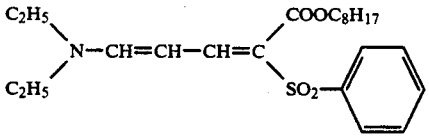
S-1
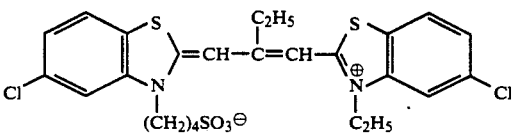

-continued

S-2

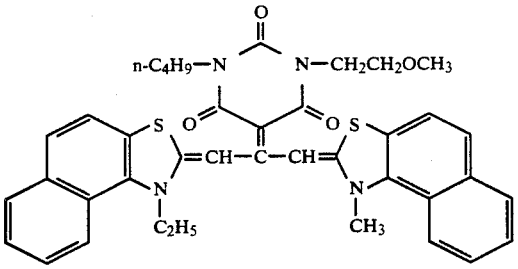

S-3

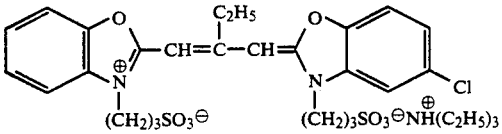

S-4

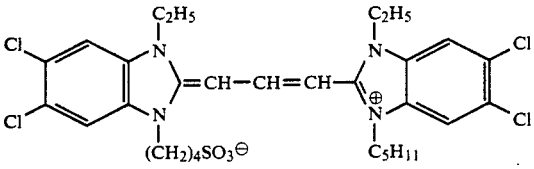

S-5

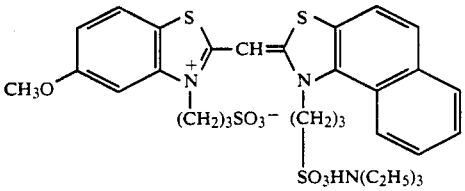

S-6

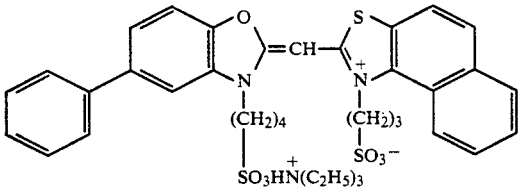

D-1

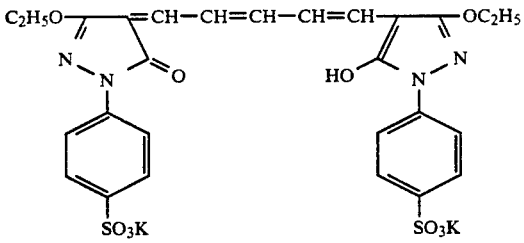

D-2

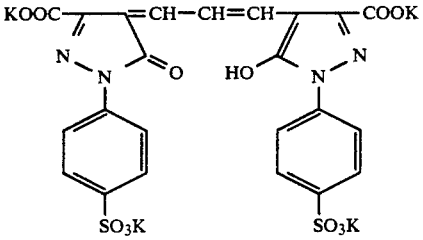

-continued

D-3

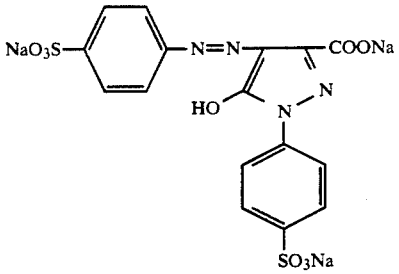

H-1

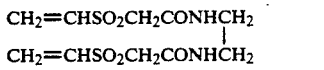

W-1

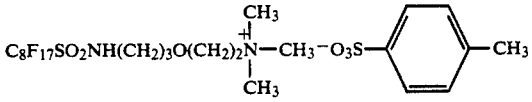

EXAMPLE 3

Samples 301 to 303, which contain Emulsions A, B and C disclosed for the first red-sensitive layer of the multilayered color-sensitive material sample of Example 1, were prepared by multilayer coating of the various layers with the compositions shown below onto cellulose triacetate film supports which had undergone undercoating treatment.

| | |
|---|---|
| Layer 1: Antihalation Layer | |
| Black Colloidal Silver | 0.18 g/m$^2$ (Ag) |
| Gelatin | 1.40 g/m$^2$ |
| Layer 2: Intermediate Layer | |
| 2,5-Di-t-pentadecylhydroquinone | 0.18 g/m$^2$ |
| C-11 | 0.07 g/m$^2$ |
| C-13 | 0.02 g/m$^2$ |
| U-11 | 0.08 g/m$^2$ |
| U-12 | 0.08 g/m$^2$ |
| Oil-2 | 0.10 g/m$^2$ |
| Oil-1 | 0.02 g/m$^2$ |
| Gelatin | 1.0 g/m$^2$ |
| Layer 3: First Red-Sensitive Emulsion Layer | |
| Silver Iodobromide Emulsion Spectrally Sensitized by Sensitizing Dyes S-11, S-12, S-13 and S-18 (Emulsions A, B and C disclosed in Example 1) | 0.50 g/m$^2$ (Ag) |
| C-12 | 0.14 g/m$^2$ |
| Oil-2 | 0.005 g/m$^2$ |
| C-20 | 0.005 g/m$^2$ |
| Gelatin | 1.20 g/m$^2$ |
| Layer 4: Second Red-Sensitive Emulsion Layer | |
| Silver Iodobromide Emulsion Spectrally Sensitized by Sensitizing Dyes S-11, S-12, S-13 and S-18 (amorphous multiple twin crystal grains having a sphere-equivalent average grain size of 0.6 μm, iodine content: 2 mol %) | 1.15 g/m$^2$ (Ag) |
| C-12 | 0.060 g/m$^2$ |
| C-13 | 0.008 g/m$^2$ |
| C-20 | 0.004 g/m$^2$ |
| Oil-2 | 0.005 g/m$^2$ |
| Gelatin | 1.50 g/m$^2$ |
| Layer 5: Third Red-Sensitive Emulsion Layer | |
| Silver Iodobromide Emulsion Spectrally Sensitized by Sensitizing Dyes S-11, S-12, S-13 and S-18 (amorphous multiple twin crystal grains having a sphere-equivalent average grain size of 0.8 μm, iodine content: 2 mol %) | 1.50 g/m$^2$ (Ag) |

-continued

| | |
|---|---|
| C-15 | 0.012 g/m$^2$ |
| C-13 | 0.003 g/m$^2$ |
| C-14 | 0.004 g/m$^2$ |
| Oil-2 | 0.32 g/m$^2$ |
| Gelatin | 1.63 g/m$^2$ |
| Layer 6: Intermediate layer | |
| Gelatin | 1.06 g/m$^2$ |
| Layer 7: First Green-Sensitive Emulsion Layer | |
| Silver Iodobromide Emulsion Spectrally Sensitized with Sensitizing Dyes S-14, S-15 and S-16 (amorphous multiple twin crystal grains having a sphere-equivalent average grain size of 0.3 μm, iodine content: 2 mol %) | 0.35 g/m$^2$ (Ag) |
| C-16 | 0.120 g/m$^2$ |
| C-11 | 0.021 g/m$^2$ |
| C-17 | 0.030 g/m$^2$ |
| C-18 | 0.025 g/m$^2$ |
| Oil-2 | 0.20 g/m$^2$ |
| Gelatin | 0.70 g/m$^2$ |
| Layer 8: Second Green-Sensitive Emulsion Layer | |
| Silver Iodobromide Emulsion Spectrally Sensitized by Sensitizing Dyes S-14, S-15 and S-16 (amorphous multiple twin crystal grains having a sphere-equivalent average grain size of 0.6 μm, iodine content: 2 mol %) | 0.75 g/m$^2$ (Ag) |
| C-16 | 0.021 g/m$^2$ |
| C-18 | 0.004 g/m$^2$ |
| C-11 | 0.002 g/m$^2$ |
| C-17 | 0.003 g/m$^2$ |
| Oil-2 | 0.15 g/m$^2$ |
| Gelatin | 0.80 g/m$^2$ |
| Layer 9: Third Green-Sensitive Emulsion Layer | |
| Silver Iodobromide Emulsion Spectrally Sensitized by Sensitizing Dyes S-14, S-15 and S-16 (amorphous multiple twin crystal grains having a sphere-equivalent average grain size of 0.2 μm, iodine content: 2 mol %) | 1.80 g/m$^2$ (Ag) |
| C-16 | 0.011 g/m$^2$ |
| C-11 | 0.001 g/m$^2$ |
| Oil-1 | 0.69 g/m$^2$ |
| Gelatin | 1.74 g/m$^2$ |
| Layer 10: Yellow Filter Layer | |
| Yellow Colloidal Silver | 0.05 g/m$^2$ (Ag) |
| 2,5-Di-t-pentadecylhydroquinone | 0.03 g/m$^2$ |
| Gelatin | 0.95 g/m$^2$ |
| Layer 11: First Blue-Sensitive Emulsion Layer | |
| Silver Iodobromide Emulsion Spectrally Sensitized by Sensitizing Dye S-17 (amorphous multiple twin crystal grains having a sphere-equivalent average grain size of 0.3 μm, iodine content: 2 mol %) | 0.24 g/m$^2$ (Ag) |
| C-19 | 0.27 g/m$^2$ |
| C-18 | 0.005 g/m$^2$ |
| Oil-2 | 0.28 g/m$^2$ |
| Gelatin | 1.28 g/m$^2$ |
| Layer 12: Second Blue-Sensitive Emulsion Layer | |
| Silver Iodobromide Emulsion Spectrally Sensitized by Sensitizing Dye S-17 (amorphous multiple twin crystal grains having a sphere-equivalent average grain size of 0.6 μm, iodine content: 2 mol %) | 0.45 g/m$^2$ (Ag) |
| C-19 | 0.098 g/m$^2$ |
| Oil-2 | 0.03 g/m$^2$ |
| Gelatin | 0.46 g/m$^2$ |
| Layer 13: Third Blue-Sensitive Emulsion Layer | |
| Silver Iodobromide Emulsion Spectrally Sensitized by Sensitizing Dye S-17 (amorphous multiple twin crystal grains having a sphere-equivalent average grain size of 0.8 μm, iodine content: 2 mol %) | 0.77 g/m$^2$ (Ag) |
| C-19 | 0.036 g/m$^2$ |
| Oil-2 | 0.07 g/m$^2$ |
| Gelatin | 0.69 g/m$^2$ |
| Layer 14: First Protective layer | |

-continued

| | |
|---|---|
| Silver Iodobromide (silver iodide: 1 mol %, average grain size: 0.07 μm) | 0.5 g/m$^2$ (Ag) |
| U-11 | 0.11 g/m$^2$ |
| U-12 | 0.17 g/m$^2$ |
| Oil-2 | 0.90 g/m$^2$ |
| Layer 15: Second Protective Layer | |
| Polymethyl Methacrylate Particles (diameter: about 1.5 μm) | 0.54 g/m$^2$ |
| U-13 | 0.15 g/m$^2$ |
| U-14 | 0.10 g/m$^2$ |
| Gelatin | 0.72 g/m$^2$ |

In addition to the above constituents, Gelatin Hardening Agent H-1 and surfactants were added to each layer.

Sample Nos. 301 to 303 obtained in this way were given a white light wedge exposure and the development processing shown below was carried out.

| Processing Stage (38° C.) | Processing Time |
|---|---|
| Color Development | 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 05 sec |

The processing solution compositions used in the processing stages were as shown below.

| | |
|---|---|
| Color Developing Solution: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.0 |
| Bleaching Solution: | |
| Ethylenediaminetetraacetic Acid Ferric Ammonium Salt | 100.0 g |
| Ethylenediaminetetraacetic Acid Disodium Salt | 10.0 g |
| Ammonium Bromide | 150.0 g |
| Ammonium Nitrate | 10.0 g |
| Water to make | 1.0 liter |
| pH | 6.0 |
| Fixing Solution: | |
| Ethylenediaminetetraacetic Acid Disodium Salt | 1.0 g |
| Sodium Sulfite | 4.0 g |
| Aqueous Ammonium Thiosulfate Solution (70%) | 175.0 ml |
| Sodium Bisulfite | 4.6 g |
| Water to make | 1.0 liter |
| pH | 6.6 |
| Stabilization Solution: | |
| Formalin (40%) | 2.0 ml |
| Polyoxyethylene-p-monononylphenyl Ether (average degree of polymerization: 10) | 0.3 g |
| Water to make | 1.0 liter |

The color negative sensitivity of the first red-sensitive layer was assessed on the basis of the relative exposures which are 2.0 greater than the minimum densities of the magenta density and yellow density. The effects of this invention are clearly evident in these results; Sample 301 having a higher sensitivity and better storage properties than Comparative Samples 302 and 303.
The structural formulae of the compounds used in Example 3 are shown below.
C-11
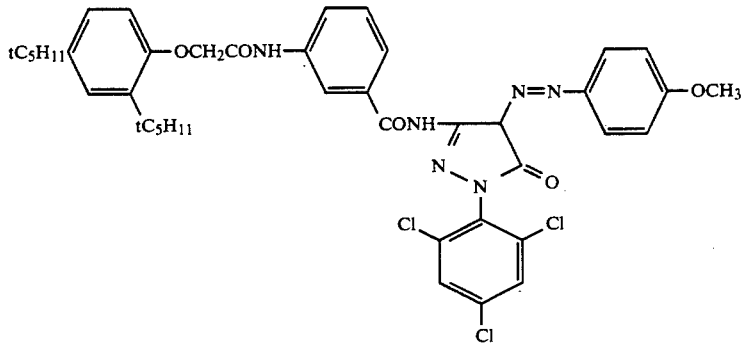
C-12
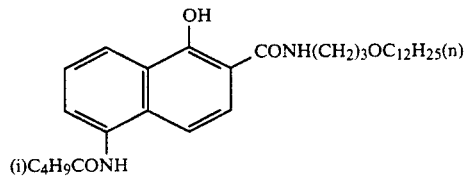
C-13
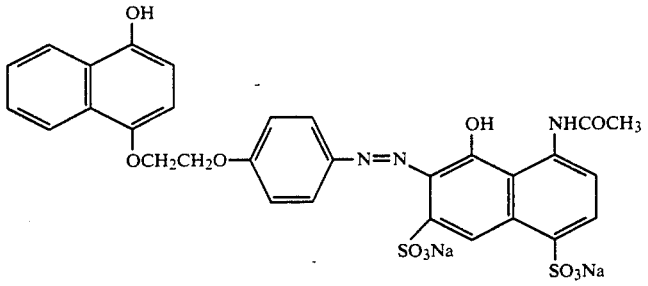
C-14
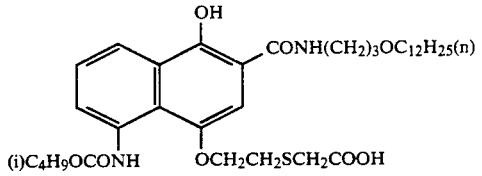
C-15
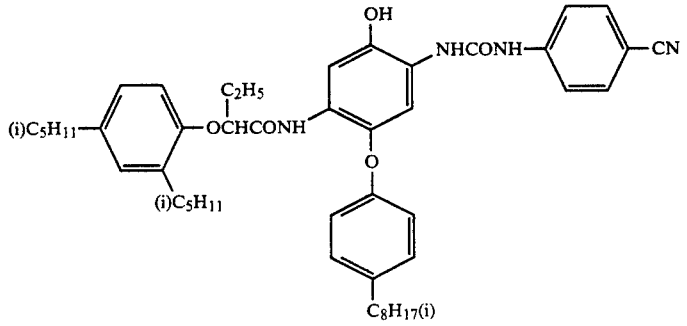

-continued
C-16
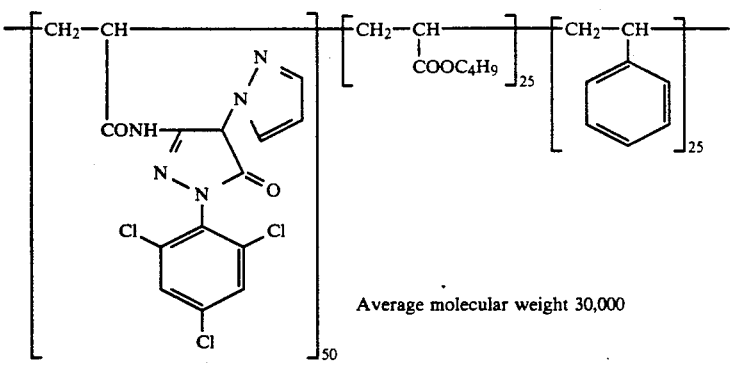
Average molecular weight 30,000
C-17
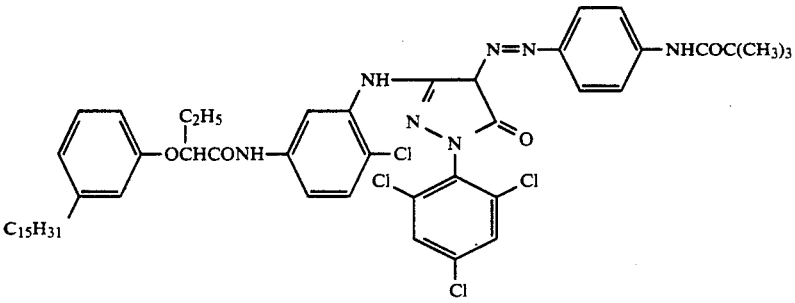
C-18
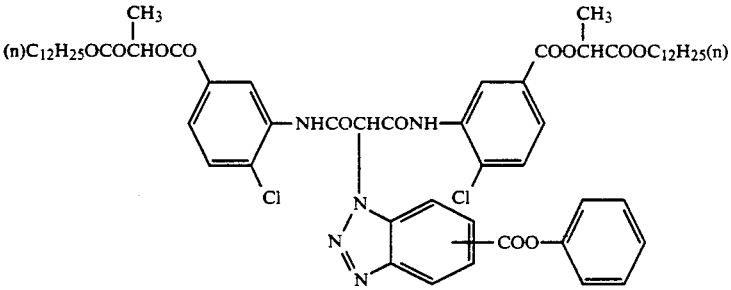
C-19
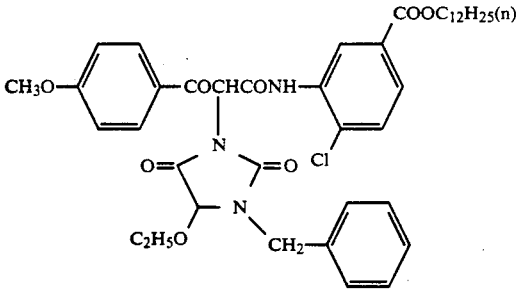
C-20
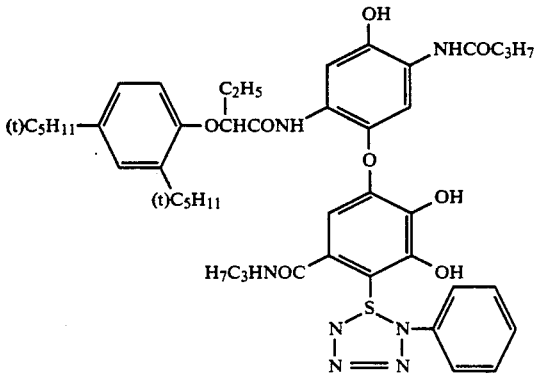

-continued
S-11
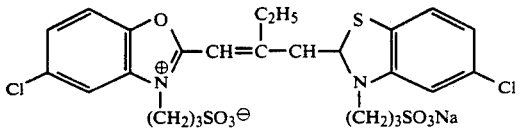
S-12
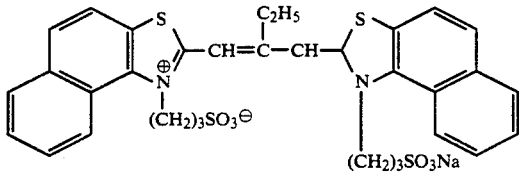
S-13
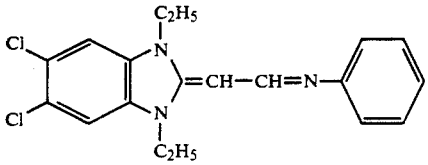
S-14
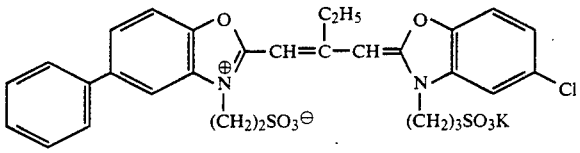
S-15
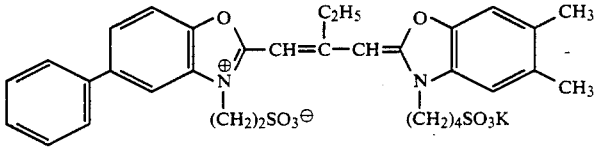
S-16
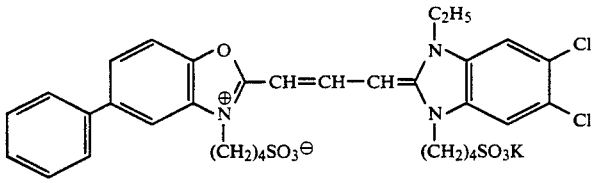
S-17
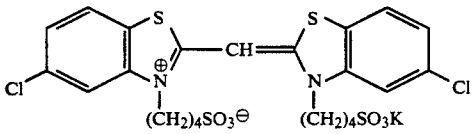
S-18
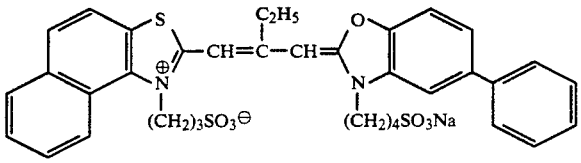

-continued

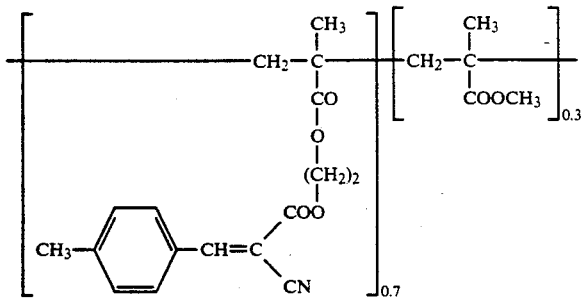

U-11

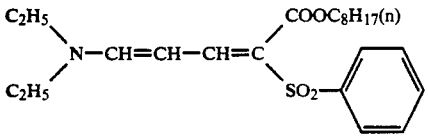

U-12

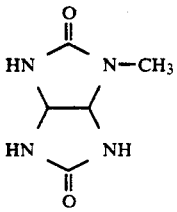

U-13

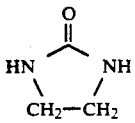

U-14 dibutyl phthalate — Oil 1 tricresyl phosphate — Oil 2

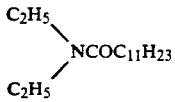

Oil 3

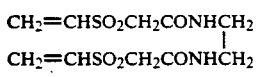

H-1

EXAMPLE 4

The 41 types of silver iodobromide emulsions shown in Table 4 were prepared. The method of producing of these emulsions is given below.

A cubic emulsion was prepared by adding a silver nitrate solution and an aqueous solution containing KBr and KI to an aqueous gelatin solution maintained at 70° C., using the double jet method, while maintaining the pBr at 3.3. This core emulsion was then divided and shells formed separately under the conditions shown below, the size of the final grains was 0.3 μm and the AgI content was 5 mol %.

Emulsion 5

Chemical sensitization was carried out by adding sodium thiosulfate and potassium chloroaurate to the above core. A shell was then deposited under the same conditions as for the core formation.

Emulsions 1, 2, 3, 4 and 6

Emulsions were prepared in the same way as for Emulsion 5 except that, of the potassium halides added during the shell formation, 1, 2, 3, 4 and 6 mol % of KI were used; these were Emulsions 1, 2, 3, 4 and 6.

Emulsions 7 and 8

Emulsions 7 and 8 were prepared in the same way as for Emulsions 3 and 5 except that chemical sensitization was only carried out after the shell deposition.

Emulsions 9 and 10

Emulsions were prepared in the same way as for Emulsions 3 and 5 except that the pBr value was lowered to 2.8 and shell deposition was carried out under conditions of a lowered silver halide solubility; these were Emulsions 9 and 10.

Emulsions 11 to 17

Emulsions were prepared in the same way as for Emulsions 2, 3, 4, 7 and 9 except that, of the potassium halides added during the core grain formation, 3 mol % of KI were used; these were Emulsions 11, 12, 13, 15 and 17. In addition, Emulsions 14 and 16 were prepared in the same way as Emulsions 15 and 17 except that 2 mol % of KI were used when depositing the shell.

Emulsions 18 to 27

Emulsions 18 to 27 were prepared in the same way as Emulsions 1 to 10 except that the pBr was 4.5 during the core grain formation.

Emulsions 28 to 37

Emulsions 28 to 37 were prepared in the same way as Emulsions 1 to 10 except that the size of the core grains was made larger.

Emulsions 38 to 41

Emulsions 39 to 41 (aspect ratio 5.0) were prepared in the same way as Emulsions 12 and 17 except that tabular grains were used as the core grains. Additionally, Emulsions 38 and 40 were prepared using 1 mol % of KI during the shell formation.

Sensitizing Dye S-1 shown in Example 2 was added to the above Emulsions 1 to 41, at 0.4 mmol/mol Ag for 1 to 27, and at 0.2 mmol/mol Ag for 28 to 41 and these were coated at 2 μg of silver per square centimeter producing Samples 101 to 141.

The above films were exposed for 10 seconds, 1/100 second, 1/100,000 second through a blue filter (BPN-42) or for 1/100 second through a minus blue filter (SC-39) and development processing was carried out using the processing solution shown below.

The sensitometry results so obtained are shown in Table 4. Here, the sensitivity is shown as the relative value of the reciprocal of the exposure which provides a density of fogging +0.1.

It will be seen from the results that the photographic materials containing emulsions having the specific latent image distribution and silver iodide distribution of this invention are better in their sensitivities and latent image storage properties than the other emulsions.

For example, Emulsion 7 is close to the emulsions of this invention in the depth at which the peak value of its latent image distribution is located and in the silver iodide distribution within the grain, however, there is a small number of latent images in the surface and a lower sensitivity than the emulsions of this invention is all that is obtained. Furthermore, Emulsion 6 is close to the emulsions of this invention in the relationship between the peak value of the latent image distribution and the latent image numbers at the surface and in the depth at which the peak value of its latent image distribution is located, however, it is different to the emulsions of this invention in the silver diode distribution within the grain and lower sensitivities are all that are obtained.

| Processing Solution: | |
|---|---|
| 1-Phenyl-3-pyrazolidone | 0.5 g |
| Hydroquinone | 10 g |
| Ethylenediaminetetraacetic Acid Disodium Salt | 2 g |
| Potassium Sulfite | 60 g |
| Boric Acid | 4 g |
| Potassium Carbonate | 20 g |
| Sodium Bromide | 5 g |
| Diethylene Glycol | 20 g |
| Adjusted with Sodium Hydroxide to pH | 10.0 |
| Water to make | 1 liter |

TABLE 4

| Sample No. | Emulsion | Size (μm) | Grain Form | Latent Image Distribution* | Average Silver Iodide Content (mol %) | Surface Silver Iodide Content (mol %) | Logarithm of the Relative Sensitivity for a Minus Blue Exposure (log E) | Change in Sensitivity upon Processing after Storage for 3 Days at 50° C. Following Minus Blue Exposure (Δ log E) |
|---|---|---|---|---|---|---|---|---|
| 101 (Invention) | 1 | 0.3 | Cubic | 1 | 5 | 1 | 3.38 | −0.03 |
| 102 (Invention) | 2 | " | " | " | " | 2 | 3.38 | −0.02 |
| 103 (Invention) | 3 | " | " | " | " | 3 | 3.37 | −0.02 |
| 104 (Invention) | 4 | " | " | " | " | 4 | 3.35 | −0.03 |
| 105 (Comparison) | 5 | " | " | " | " | 5 | 3.30 | −0.05 |
| 106 (Comparison) | 6 | " | " | " | " | 6 | 3.27 | −0.07 |
| 107 (Comparison) | 7 | " | " | 2 | " | 3 | 3.23 | −0.06 |
| 108 (Comparison) | 8 | " | " | " | " | 5 | 3.18 | −0.07 |
| 109 (Comparison) | 9 | " | " | 3 | " | 3 | 3.18 | −0.13 |
| 110 (Comparison) | 10 | " | " | " | " | 5 | 3.14 | −0.14 |
| 111 (Invention) | 11 | " | " | 1 | 3 | 2 | 3.38 | −0.00 |
| 112 (Comparison) | 12 | " | " | " | " | 3 | 3.34 | −0.02 |
| 113 (Comparison) | 13 | " | " | " | " | 4 | 3.31 | −0.04 |
| 114 (Comparison) | 14 | " | " | 2 | " | 2 | 3.21 | −0.03 |
| 115 (Comparison) | 15 | " | " | " | " | 3 | 3.18 | −0.03 |
| 116 (Comparison) | 16 | " | " | 3 | " | 2 | 3.24 | −0.08 |
| 117 (Comparison) | 17 | " | " | " | " | 3 | 3.16 | −0.10 |
| 118 (Invention) | 18 | " | Octahedral | 1 | 5 | 1 | 3.35 | −0.03 |
| 119 (Invention) | 19 | " | " | " | " | 2 | 3.35 | −0.03 |
| 120 (Invention) | 20 | " | " | " | " | 3 | 3.35 | −0.03 |
| 121 (Invention) | 21 | " | " | " | " | 4 | 3.34 | −0.05 |
| 122 (Comparison) | 22 | " | " | " | " | 5 | 3.27 | −0.07 |
| 123 (Comparison) | 23 | " | " | " | " | 6 | 3.22 | −0.09 |
| 124 (Comparison) | 24 | " | " | 2 | " | 3 | 3.20 | −0.12 |
| 125 (Comparison) | 25 | " | " | " | " | 5 | 3.15 | −0.14 |
| 126 (Comparison) | 26 | " | " | 3 | " | 3 | 3.15 | −0.18 |
| 127 (Comparison) | 27 | " | " | " | " | 5 | 3.10 | −0.19 |
| 128 (Invention) | 28 | 0.8 | Cubic | 1 | " | 1 | 3.19 | −0.00 |
| 129 (Invention) | 29 | " | " | " | " | 2 | 4.16 | −0.00 |
| 130 (Invention) | 30 | " | " | " | " | 3 | 4.15 | −0.00 |
| 131 (Invention) | 31 | " | " | " | " | 4 | 4.14 | −0.01 |
| 132 (Comparison) | 32 | " | " | " | " | 5 | 4.09 | −0.03 |
| 133 (Comparison) | 33 | " | " | " | " | 6 | 4.05 | −0.05 |
| 134 (Comparison) | 34 | " | " | 2 | " | 3 | 4.04 | −0.04 |

TABLE 4-continued

| Sample No. | Emulsion | Size (μm) | Grain Form | Latent Image Distribution* | Average Silver Iodide Content (mol %) | Surface Silver Iodide Content (mol %) | Logarithm of the Relative Sensitivity for a Minus Blue Exposure (log E) | Change in Sensitivity upon Processing after Storage for 3 Days at 50° C. Following Minus Blue Exposure (Δ log E) |
|---|---|---|---|---|---|---|---|---|
| 135 (Comparison) | 35 | " | " | " | " | 5 | 3.99 | −0.05 |
| 136 (Comparison) | 36 | " | " | 3 | " | 3 | 3.91 | −0.09 |
| 137 (Comparison) | 37 | " | " | " | " | 5 | 3.87 | −0.13 |
| 138 (Invention) | 38 | 1.1 | Tabular | 1 | 3 | 1 | 4.51 | +0.02 |
| 139 (Comparison) | 39 | " | " | " | " | 3 | 4.39 | −0.04 |
| 140 (Comparison) | 40 | " | " | 3 | " | 1 | 4.17 | −0.06 |
| 141 (Comparison) | 41 | " | " | " | " | 3 | 4.18 | −0.08 |

*The latent image distribution determined by the method described in this text was as given below.
1 The latent image distribution of the surface was 0.3 to 0.6 time of the maximum peak value and the peak value was at a depth of 0.003 μm to 0.006 μm from the surface.
2 The latent image distribution at the surface was 0.1 time or less of the maximum peak value located within the grain.
3 The latent image distribution maximum was at the surface.

EXAMPLE 5

A multilayer color photosensitive material with layers of the same composition as in Example 2 was prepared on a cellulose triacetate film support which had undergone an undercoating in the same way as in Example 2. However, Emulsion 2 of Example 4 was used in Layer 5. This was Sample No. 501.

As is shown in Table 5, Samples 502 to 504 were obtained in the same way except that the emulsions used in Layer 5 were varied.

Exposure and development processing were carried out in the same way as for Example 2. The results obtained are shown in Table 5.

TABLE 5

| Sample No. | Emulsion Used in Layer 5 | Relative Red Reversal Sensitivity |
|---|---|---|
| 501 (Invention) | 2 | 100 |
| 502 (Comparison) | 5 | 92 |
| 503 (Comparison) | 7 | 85 |
| 504 (Comparison) | 9 | 80 |

It will be seen from the above that emulsions having the latent image distribution and the silver iodide distribution within the grain of this invention exhibit outstanding reversal sensitivities.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one silver halide emulsion layer on a support, wherein the latent image distribution of silver halide grains present in said at least one emulsion layer has at least one peak value within said grains, the location of said peak value is at a depth of less than 0.01 μm from the surface of the grains, the ratio of the latent image number on the shell surface to the maximum peak value is about 1/5 or more and less than 1, and the silver iodide content of the grain surface region is 90% or less of the average content of all of the grains.

2. The silver halide photographic material as claimed in claim 6, wherein said at least one peak value is at a depth of about 0.003 to 0.006 μm from the surface of the grains.

3. The silver halide photographic material as claimed in claim 1, wherein the average silver iodide content of said grains is 15 mol % or less.

4. The silver halide photographic material as claimed in claim 1, wherein the average silver iodide content of said grains is from 3 to 15 mol %.

* * * * *